US011874003B2

(12) United States Patent
Yamasuso et al.

(10) Patent No.: US 11,874,003 B2
(45) Date of Patent: Jan. 16, 2024

(54) OUTDOOR UNIT OF AIR-CONDITIONING APPARATUS

(71) Applicant: Mitsubishi Electric Corporation, Tokyo (JP)

(72) Inventors: Masaya Yamasuso, Tokyo (JP); Yohei Kawaguchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 328 days.

(21) Appl. No.: 17/427,309

(22) PCT Filed: Apr. 8, 2019

(86) PCT No.: PCT/JP2019/015292
§ 371 (c)(1),
(2) Date: Jul. 30, 2021

(87) PCT Pub. No.: WO2020/208675
PCT Pub. Date: Oct. 15, 2020

(65) Prior Publication Data
US 2022/0128247 A1 Apr. 28, 2022

(51) Int. Cl.
*F24F 1/56* (2011.01)
*F24F 1/16* (2011.01)

(52) U.S. Cl.
CPC . *F24F 1/56* (2013.01); *F24F 1/16* (2013.01)

(58) Field of Classification Search
CPC ..... F24F 1/56; F24F 1/16; F24F 1/22; F24F 1/20
See application file for complete search history.

(56) References Cited

U.S. PATENT DOCUMENTS

2010/0294466 A1* 11/2010 Shimaoka ..... F24F 1/54 165/104.33
2018/0372344 A1 12/2018 Abukawa et al.

FOREIGN PATENT DOCUMENTS

CN 108700311 A 10/2018
JP H05-133569 A 5/1993
(Continued)

OTHER PUBLICATIONS

Office Action dated Dec. 28, 2022 issued in corresponding CN patent application No. 201980093933.0 (and English machine translation).
(Continued)

*Primary Examiner* — Cassey D Bauer
(74) *Attorney, Agent, or Firm* — POSZ LAW GROUP, PLC

(57) ABSTRACT

An outdoor unit of an air-conditioning apparatus includes: a housing; a heat exchanger provided in the housing; an electric component box provided in the housing; and a separator that partitions the inside of the housing into a first chamber and a second chamber. The separator is provided on a front surface of the heat exchanger. The first chamber and the second chamber are provided side by side in a lateral direction as viewed in a side-on view of the outdoor unit. The electric component box is provided on the front surface of the heat exchanger and above the separator. The outdoor unit includes a first positioning member and a second positioning member. The first positioning member is provided on the electric component box, and determines the position of the electric component box in a vertical direction and a front-rear direction relative to the heat exchanger. The second positioning member is provided on a bottom surface of the electric component box, and determines the position
(Continued)

of the electric component box in the lateral direction relative to the separator.

8 Claims, 11 Drawing Sheets

(56) References Cited

FOREIGN PATENT DOCUMENTS

| | | | |
|---|---|---|---|
| JP | H06-159739 | A | 6/1994 |
| JP | H09-280608 | A | 10/1997 |
| JP | H11-083083 | A | 3/1999 |
| JP | H11-248199 | A | 9/1999 |
| JP | 2000-039188 | A | 2/2000 |
| JP | 2005-291641 | A | 10/2005 |
| JP | 2009085466 | A | 4/2009 |
| JP | 2015-117858 | A | 6/2015 |
| WO | 2019/058461 | A1 | 3/2019 |
| WO | 2019058461 | A1 | 3/2019 |

OTHER PUBLICATIONS

International Search Report dated May 14, 2019, issued in corresponding International Patent Application No. PCT/JP2019/015292 (and English Machine Translation).
Examination Report dated May 9, 2022 issued in corresponding AU Patent Application No. 2019445121.
Office Action dated May 31, 2022 issued in corresponding CN Patent Application No. 201980093933.0 (and English translation).
Office Action dated Jul. 15, 2023 issued in corresponding CN patent application No. 201980093933.0 (and English translation).

* cited by examiner

OUTDOOR UNIT OF AIR-CONDITIONING APPARATUS

CROSS REFERENCE TO RELATED APPLICATION

This application is a U.S. National Stage Application of International Patent Application No. PCT/JP2019/015292 filed on Apr. 8, 2019, the contents of which is incorporated herein by reference.

TECHNICAL FIELD

The present disclosure relates to an outdoor unit of an air-conditioning apparatus and a positioning structure of an electric component box.

BACKGROUND

In existing air-conditioning apparatuses, the inside of an outdoor unit is partitioned into an air-passage chamber and a machine chamber by a separator. In the air-passage chamber, a fan is provided, and in the machine chamber, a compressor is provided. Furthermore, the outdoor unit includes an electric component box that houses a communication substrate for communication with an indoor unit of the air-conditioning apparatus and a control substrate for control of components in the outdoor unit. The fan and the compressor are provided on a base plate located on a bottom surface of the outdoor unit, and the electric component box is provided at an upper part of the outdoor unit.

Outdoor units include a given type of outdoor unit in which a claw is provided at a rear side of an electric component box and a window portion formed at a plate of a heat exchanger is hooked to the claw, thereby fixing the electric component box. Furthermore, Patent Literature 1 discloses an outdoor unit having a configuration in which a tongue-piece portion is provided at an electric equipment box that is an electric component box, and the electric equipment box is fixed to part of a heat exchanger that is located on a rear side of the outdoor unit, using the tongue-piece portion.

Patent Literature

Patent Literature 1: Japanese Unexamined Patent Application Publication No. Hei 11-248199

When an electric component box is set, it is necessary to position the electric component box such that the electric component box is fixed by a fixing mechanism provided on the back side of the electric component box. To be more specific, a worker searches for a set position of the electric component box, while supporting the electric component box with his or her hand. The electric component box houses a communication substrate and a control substrate, and thus has such a weight that the worker cannot easily stably support the electric component box with his or her hands. Therefore, for any of various types of outdoor units, the worker must search for the position where the electric component box is to be set, and the workability of positioning the electric component box is not satisfactory.

SUMMARY

The present disclosure is applied to solve the above problem, and relates to an outdoor unit of an air-conditioning apparatus that is improved in workability of positioning an electric component box.

An outdoor unit of an air-conditioning apparatus according to an embodiment of the present disclosure includes: a housing; a heat exchanger provided in the housing; an electric component box provided in the housing; and a separator that partitions an inside of the housing into a first chamber and a second chamber. The separator is provided at a front surface of the heat exchanger. The first chamber and the second chamber are provided side by side in a lateral direction as viewed in a head-on view of the outdoor unit. The electric component box is provided at the front surface of the heat exchanger and above the separator. The outdoor unit includes a first positioning member and a second positioning member. The first positioning member is provided on the electric component box, and determines a position of the electric component box in a vertical direction and a front-rear direction relative to the heat exchanger. The second positioning member is provided on a bottom surface of the electric component, and determines a position of the electric component box in the lateral direction relative to the separator.

In the outdoor unit of the air-conditioning apparatus according to the embodiment of the present disclosure, the position of the electric component box in the vertical direction and in the front-rear direction relative to the heat exchanger is determined by the first positioning member, and the position of the electric component box in the lateral direction relative to the separator is determined by the second positioning member. In other words, the accuracy of positioning of the electric component box is improved. Accordingly, the workability at the time of setting the electric component box at the outdoor unit is improved.

DETAILED DESCRIPTION

Embodiments of an outdoor unit of an air-conditioning apparatus according to the present disclosure will be described with reference to the drawings. The descriptions concerning the embodiments are not limiting, and various modifications can be made without departing from the scope of the present disclosure. Furthermore, the present disclosure covers all combinations of combinable ones of configurations described below regarding the embodiments. The outdoor units of the air-conditioning apparatuses as illustrated in the figures are merely examples of outdoor units of air-conditioning apparatuses according to the present disclosure, and illustration of the outdoor units of the air-conditioning apparatuses in the figures is not limiting. Furthermore, in the following description, in order that the embodiments be easily understood, terms related to directions (such as "upper", "lower", "right", "left", front", and "rear") are used as appropriate. However, these terms are used only for explanation, that is, they do not limit the embodiments. In addition, in each of the figures, components that are the same as or equivalent to those in a previous figure or figures are denoted by the same reference signs, and the same is true of the entire text of the present specification. In the figures, relative relationships in size or shape between components may be different from those of actual components.

Embodiment 1

Figure 1:
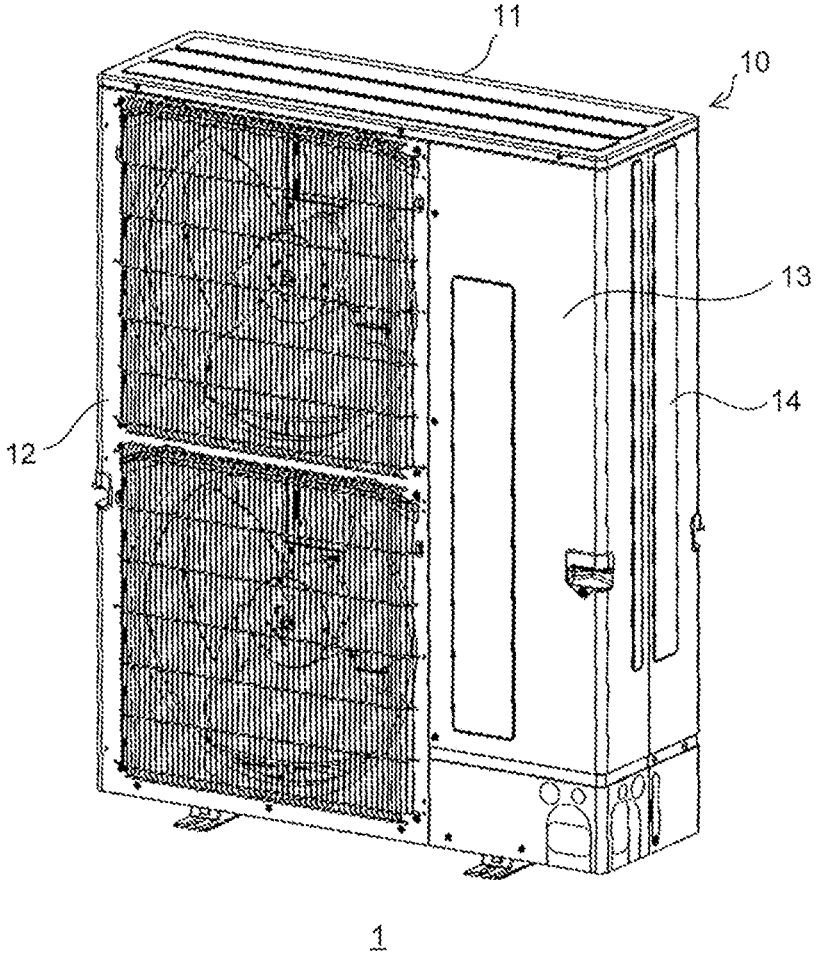
FIG. 1 is a perspective view of an outdoor unit of an air-conditioning apparatus according to Embodiment 1.

FIG. 1 is a perspective view of an outdoor unit of an air-conditioning apparatus according to Embodiment 1. A housing 10 of an outdoor unit 1 includes a top panel 11, an air-passage-side front panel 12, a machine-chamber front panel 13, and a machine-chamber side panel 14. The top panel 11 is provided at an upper portion of the outdoor unit 1. The air-passage-side front panel 12 is provided at a front surface of the housing 10 and on an air-passage chamber side, which will be described below. The machine-chamber front panel 13 is provided at the front surface of the housing 10 and on a machine chamber side, which will be described below. In Embodiment 1, the air-passage-side front panel 12 is provided on a left side as viewed in the head-on view of the outdoor unit 1, and the machine-chamber front panel 13 is provided on a right side as viewed in the head-on view of the outdoor unit 1. The machine-chamber side panel 14 is provided on a right side surface of the housing 10 and covers a right side surface and part of a rear surface of the outdoor unit 1, as viewed in the head-on view of the outdoor unit 1.

Figure 2:
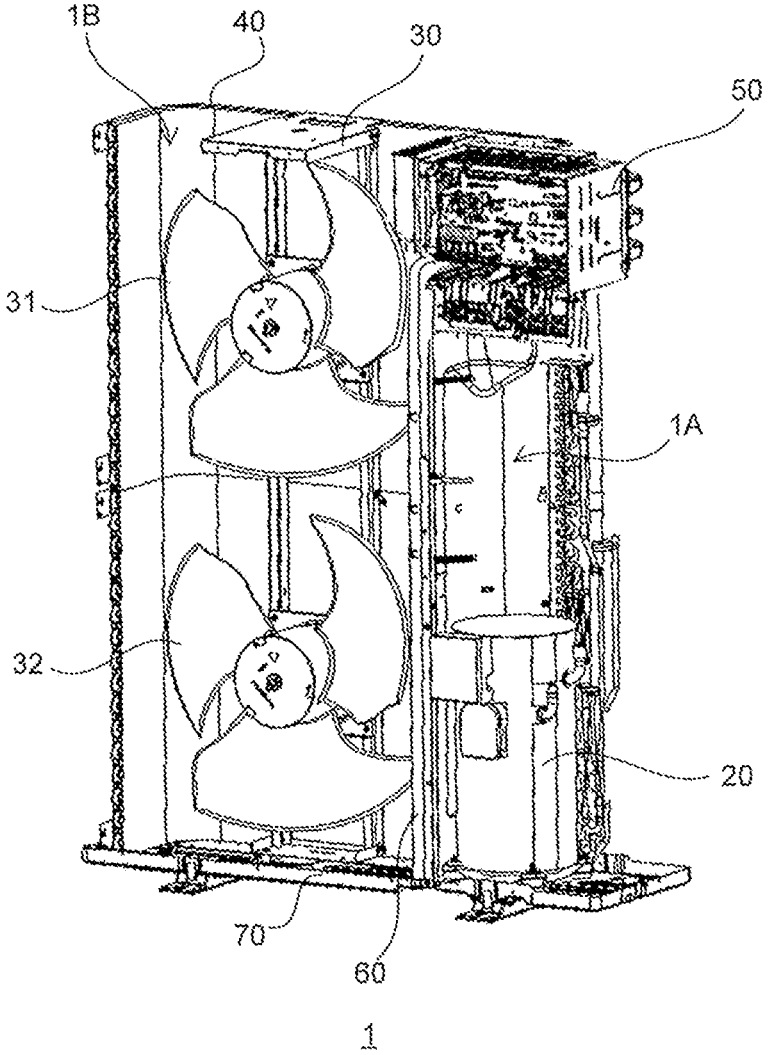
FIG. 2 is a perspective view illustrating the inside of the outdoor unit of the air-conditioning apparatus according to Embodiment 1.

FIG. 2 is a perspective view illustrating the inside of the outdoor unit of the air-conditioning apparatus according to Embodiment 1. FIG. 2 illustrates the outdoor unit 1, with the top panel 11, the air-passage-side front panel 12, the machine-chamber front panel 13, and the machine-chamber side panel 14 removed from the outdoor unit 1. The outdoor unit 1 includes a compressor 20, an upper fan 31, a lower fan 32, a heat exchanger 40, an electric component box 50, and a separator 60. The inside of the housing 10 is partitioned into a machine chamber 1A that is a first chamber and an air-passage chamber 1B that is a second chamber, by the separator 60. The machine chamber 1A and the air-passage chamber 1B are provided side by side in a lateral direction as viewed in the head-on view of the outdoor unit 1. The machine chamber 1A is located on the right side, and the air-passage chamber 1B is located on the left side, as viewed in the head-on view of the outdoor unit 1. The upper fan 31, the lower fan 32, the heat exchanger 40, and the electric component box 50 are provided in the housing 10.

The upper fan 31 and the lower fan 32 are provided in the air-passage chamber 1B. Each of the upper fan 31 and the lower fan 32 is a propeller fan. In the air-passage chamber 1B, a fan-motor fixing metal plate 30 is provided. The fan-motor fixing metal plate 30 is fixed to a base 70 provided at a bottom portion of the outdoor unit 1. A motor of the upper fan 31 and a motor of the lower fan 32 are fixed to the fan-motor fixing metal plate 30. The upper fan 31 is provided at the upper portion of the outdoor unit 1, and the lower fan 32 is provided at a lower portion of the outdoor unit 1. The compressor 20 is provided in the machine chamber 1A. The compressor 20 is provided at the base 70. The upper and lower fans 31 and 32 and the compressor 20 are provided side by side in the lateral direction as viewed in the head-on view of the outdoor unit 1.

The heat exchanger 40 has a function of causing heat exchange to be performed between refrigerant and air that is supplied by driving the upper and lower fans 31 and 32. The heat exchanger 40 is L-shaped as viewed in plan view, and is located at the rear surface and at the left side surface as viewed in the head-on view of the outdoor unit 1. The heat exchanger 40 is provided on the base 70.

The electric component box 50 is a box-shaped member having a substantially cuboid shape as a whole. The electric component box 50 houses a control substrate that controls components provided in the outdoor unit 1, and a communication substrate for use in communication between the outdoor unit 1 and an indoor unit of the air-conditioning apparatus. The electric component box 50 is provided at the front surface of the heat exchanger 40 and above the separator 60.

Figure 3:
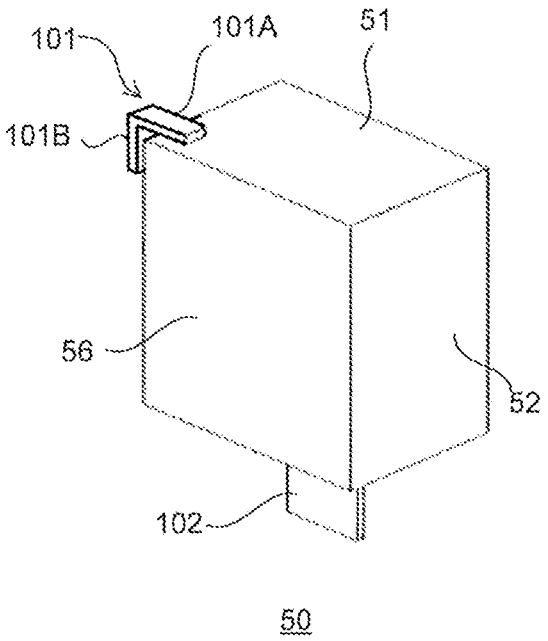
FIG. 3 is a perspective view schematically illustrating an electric component box as viewed from an upper left side.
Figure 4:
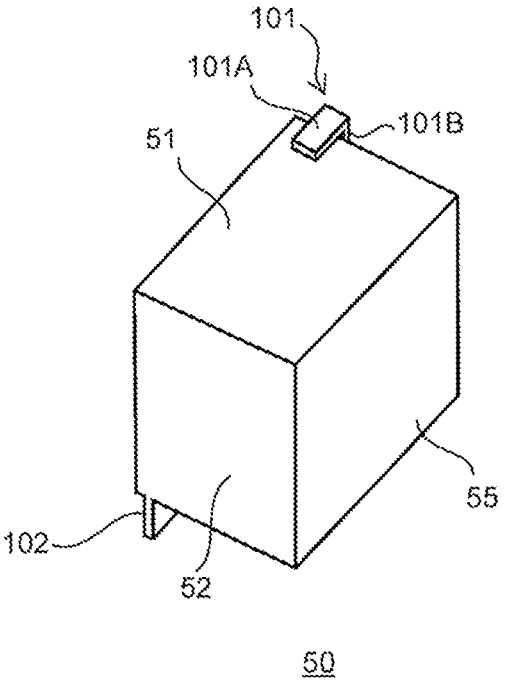
FIG. 4 is a perspective view schematically illustrating the electric component box as viewed from an upper right side.
Figure 5:
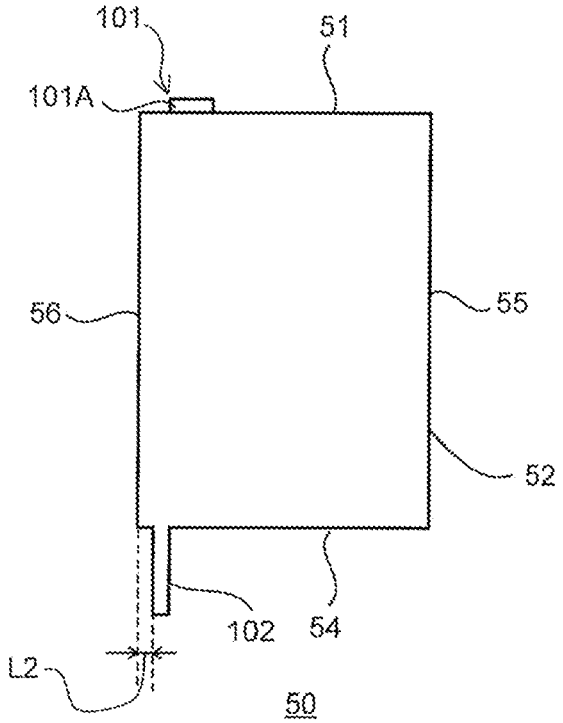
FIG. 5 is a front view schematically illustrating the electric component box.
Figure 6:
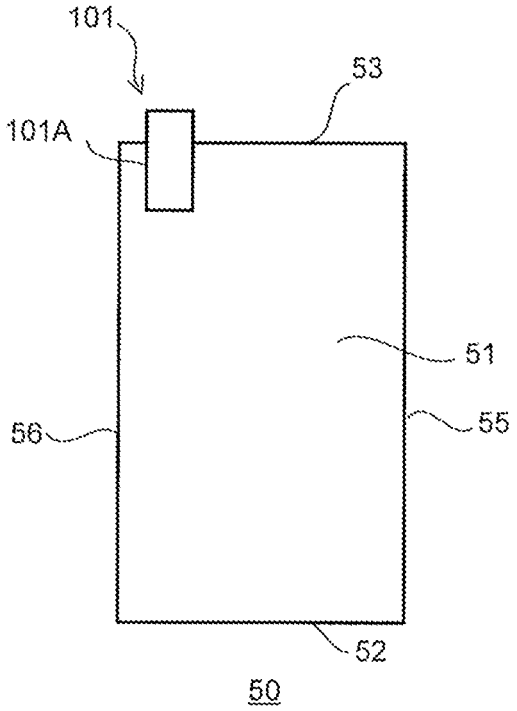
FIG. 6 is a plan view schematically illustrating the electric component box.
Figure 7:
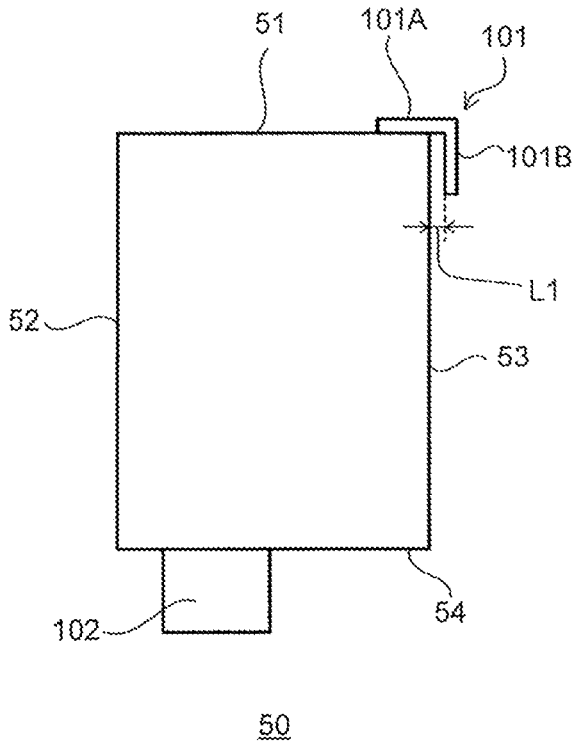
FIG. 7 is a right side view schematically illustrating the electric component box.

FIG. 3 is a perspective view schematically illustrating the electric component box as viewed from an upper left side. FIG. 4 is a perspective view schematically illustrating the electric component box as viewed from an upper right side. FIG. 5 is a front view schematically illustrating the electric component box. FIG. 6 is a plan view schematically illustrating the electric component box. FIG. 7 is a right side view schematically illustrating the electric component box. The electric component box 50 is a member having a substantially cuboid shape, and includes a top surface portion 51, a front surface portion 52, a rear surface portion 53, a bottom surface portion 54, a right side portion 55, and a left side portion 56. FIG. 3 illustrates the electric component box 50 such that the top surface portion 51 and the left side portion 56 are viewed. As described below, in the outdoor unit 1, the front surface portion 52 is located on the front surface side of the outdoor unit 1, and the rear surface portion 53 is located on the rear surface side of the outdoor unit 1. The right side portion 55 is located on the right side, and the left side portion 56 is located on the left side, as viewed in the head-on view of the outdoor unit 1.

A first positioning member 101 is provided at the top surface portion 51 of the electric component box 50. The first positioning member 101 includes a first plate portion 101A and a second plate portion 101B. The first plate portion 101A is in contact with the top surface portion 51 of the electric component box 50, and extends in a direction away from the electric component box 50 along a direction from the front surface portion 52 toward the rear surface portion 53. The second plate portion 101B intersects the first plate portion 101A at a right angle, and extends downward. As illustrated in FIG. 7, the first positioning member 101 has an L-shape as viewed side-on. Furthermore, a gap is provided between the second plate portion 101B of the first positioning member 101 and the rear surface portion 53. In Embodiment 1, the gap is set to have a width L1 slightly greater than a thickness of the heat exchanger 40. The first positioning member 101 is subjected to adhesion bending process.

The first plate portion 101A is fixed to the electric component box 50 by a fixing member such as a screw not illustrated. The first positioning member 101 can be detached from the electric component box 50 by detaching the fixing member that fixes the first plate portion 101A. In other words, the first positioning member 101 is detachably attached to the electric component box 50.

A second positioning member 102 is provided on the bottom surface portion 54 of the electric component box 50. The second positioning member 102 is a plate member. As illustrated in FIGS. 5 and 7, the second positioning member 102 protrudes downward from the bottom surface portion 54. As illustrated in FIGS. 3 and 7, the second positioning member 102 extends in a front-back direction of the electric component box 50, that is, in a front-back direction of the outdoor unit 1. In other words, the second positioning member 102 extends in parallel with the right side portion 55 and the left side portion 56. As illustrated in FIG. 5, at the bottom surface portion 54, the second positioning member 102 is provided apart from the left side portion 56 by a distance L2. In Embodiment 1, the distance L2 is slightly greater than the thickness of the above separator 60.

At the bottom surface portion 54 of the electric component box 50, the second positioning member 102 is provided closer to the front surface portion 52 than to the rear surface portion 53.

The second positioning member 102 may be formed integrally with the bottom surface portion 54. Alternatively, the second positioning member 102 may be formed separate from the electric component box 50 and fixed to the bottom surface portion 54 by, for example, a screw or an adhesive.

Figure 8:
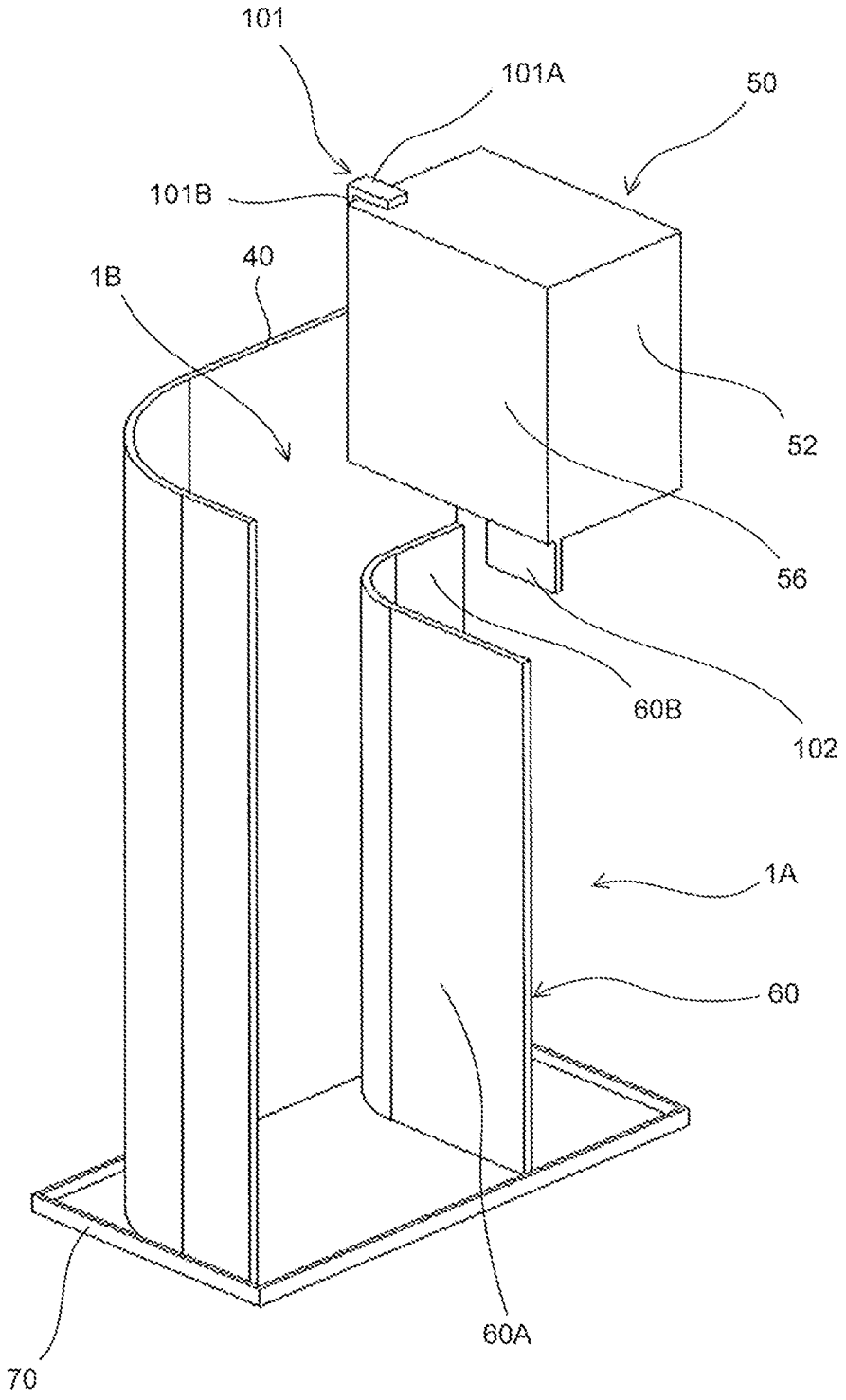
FIG. 8 is an exploded perspective view conceptually illustrating relative positional relationship between components in the outdoor unit.
Figure 9:
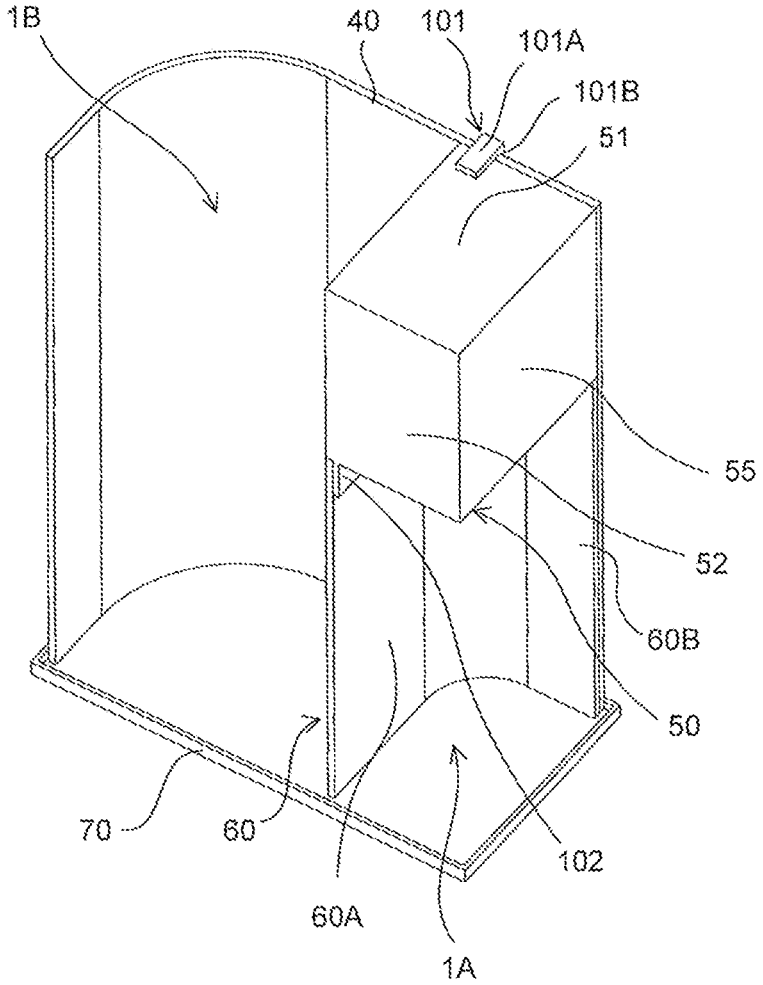
FIG. 9 is a perspective view conceptually illustrating the relative positional relationship between components in the outdoor unit.
Figure 10:
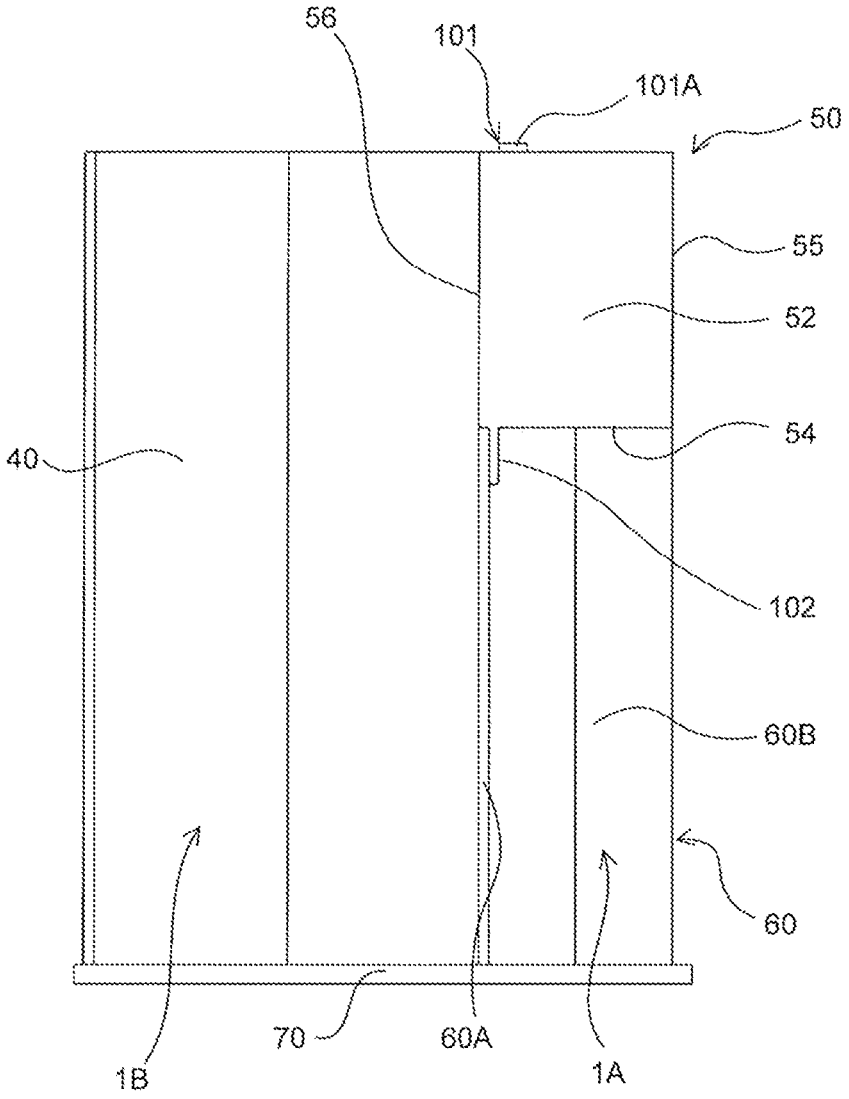
FIG. 10 is a front view conceptually illustrating the relative positional relationship between the components in the outdoor unit.
Figure 11:
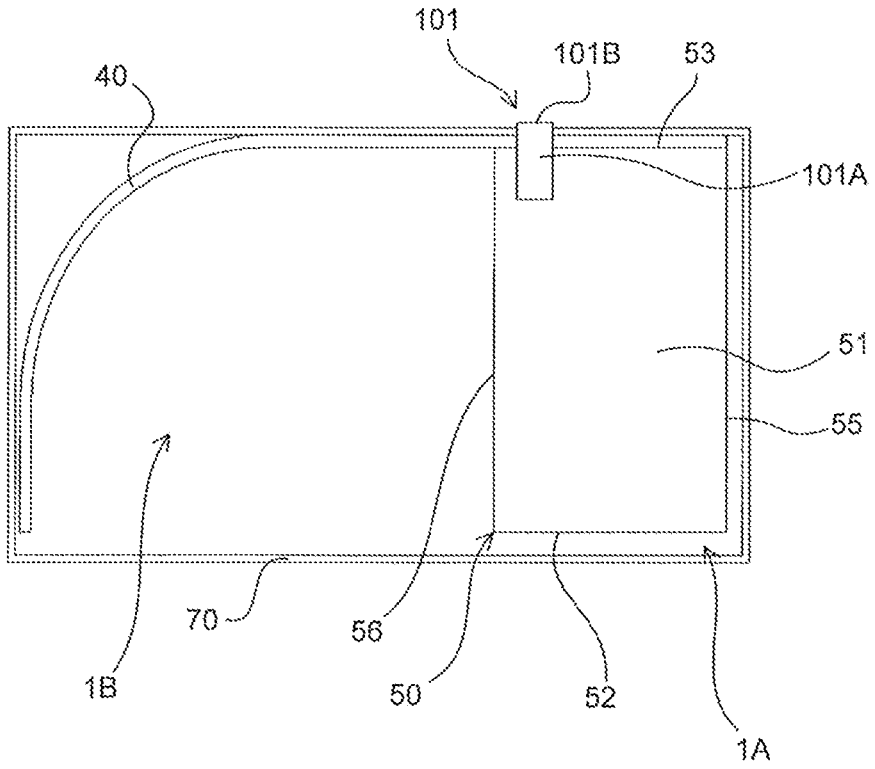
FIG. 11 is a plan view conceptually illustrating the relative positional relationship between the components in the outdoor unit.

FIG. 8 is an exploded perspective view conceptually illustrating a relative positional relationship between components provided in the outdoor unit 1. FIG. 8 illustrates the heat exchanger 40, the electric component box 50, the separator 60, and the base 70 as viewed from the upper left side with respect to the outdoor unit 1. FIG. 9 is a perspective view conceptually illustrating the relative positional relationship between the components in the outdoor unit 1. FIG. 9 illustrates the heat exchanger 40, the electric component box 50, the separator 60, and the base 70 as viewed from the upper right side with respect to the outdoor unit 1. FIG. 10 is a front view conceptually illustrating the relative positional relationship between the components in the outdoor unit 1. FIG. 11 is a plan view conceptually illustrating the relative positional relationship between the components in the outdoor unit 1.

As illustrated in FIG. 8, the separator 60 includes a first surface 60A and a second surface 60B. The first surface 60A and the second surface 60B intersect each other, and the separator 60 has an L-shape as viewed in plan view. The first surface 60A extends in the front-rear direction of the outdoor unit 1, and the second surface 60B extends in a direction from the first surface 60A toward the right side surface of the outdoor unit 1 on the rear surface side of the outdoor unit 1. The first surface 60A is located at the front surface of the heat exchanger 40.

As illustrated in FIGS. 9 and 11, an upper end of the heat exchanger 40 is held by the second plate portion 101B of the first positioning member 101 and the electric component box 50. As described above, the heat exchanger 40 is provided on the base 70. The first positioning member 101 is fixed to the top surface portion 51 of the electric component box 50. Thus, since the upper end of the heat exchanger 40 is held by the second plate portion 101B and the electric component box 50, even if an external force is applied from the front surface portion 52 to the electric component box 50, displacement of the electric component box 50 toward the rear surface is reduced. Furthermore, even if an external force is applied from the rear surface portion 53 to the electric component box 50, displacement of the electric component box 50 toward the front surface is reduced. That is, since the upper end of the heat exchanger 40 is held by the second plate portion 101B and the electric component box 50, the position of the electric component box 50 in the front-rear direction of the outdoor unit 1 is determined.

As illustrated in FIG. 10, the second positioning member 102 is located in the machine chamber 1A, and is in contact with the first surface 60A of the separator 60 from a machine chamber side where the machine chamber 1A is located. Thus, even if an external force is applied from the right side portion 55 to the electric component box 50, displacement of the electric component box 50 toward the air-passage chamber 1B is reduced. That is, the position of the electric component box 50 in the lateral direction is determined.

As illustrated in FIGS. 9 and 10, the electric component box 50 is provided on the separator 60 while being positioned by the first positioning member 101 and the second positioning member 102 as described above. More specifically, at the bottom surface portion 54 of the electric component box 50, an end portion of the bottom surface portion 54 that is continuous with the left side portion 56 and an end of the bottom surface portion 54 that is continuous with the rear surface portion 53 are in contact with an upper end of the separator 60. In other words, the electric component box 50 is held by the first positioning member 101 and the separator 60. Thus, even if an external force is applied from the top surface portion 51 to the electric component box 50, downward displacement of the electric component box 50 is reduced. Even if an external force is applied from the bottom surface portion 54 to the electric component box 50, upward displacement of the electric component box 50 is reduced. In other words, the position of the electric component box 50 in the vertical direction of the outdoor unit 1 is determined.

As described above, at the bottom surface portion 54, the second positioning member 102 is located apart from the left side portion 56 by the distance L2 slightly greater than the thickness of the separator 60. Thus, when the electric component box 50 is positioned in the lateral direction by the second positioning member 102, a surface of the left side portion 56 of the electric component box 50 that is closer to the air-passage chamber 1B and a surface of the first surface 60A of the separator 60 that is closer to the air-passage chamber 1B are substantially flush with each other. That is, when the electric component box 50 is positioned by the second positioning member 102, the left side portion 56 of the electric component box 50 partitions together with the separator 60 the inside of the housing 10 into the machine chamber 1A and the air-passage chamber 1B.

The electric component box 50 is provided in the outdoor unit 1 in the following manner. As illustrated in FIG. 8, the electric component box 50 is brought close to the heat exchanger 40 and the separator 60 from an upper region located above the heat exchanger 40 and the separator 60 and from the right of the separator 60, with the first positioning member 101 fixed to the electric component box 50. Then, the second positioning member 102 is brought into contact with the first surface 60A of the separator 60. In addition, the upper end of the heat exchanger 40 is inserted into the gap between the second plate portion 101B of the first positioning member 101 and the rear surface portion 53 of the electric component box 50 as illustrated in FIG. 7. As a result, the position of the electric component box 50 in the height direction, in the front-rear direction, and in the lateral direction of the outdoor unit 1 is determined as described above, and the electric component box 50 is temporarily fixed. Thereafter, the electric component box 50 temporarily fixed is firmly fixed to the heat exchanger 40 and the separator 60 by, for example, screws.

According to Embodiment 1, the electric component box 50 is easily positioned by the first positioning member 101 and the second positioning member 102 in the above temporarily fixing step before the electric component box 50 is fixed. That is, it is possible to improve a positioning accuracy in the case where the electric component box 50 is temporarily fixed. Therefore, the workability at the time of setting the electric component box 50 at the outdoor unit 1 is improved.

According to Embodiment 1, the gap is provided between the second plate portion 101B of the first positioning member 101 and the rear surface portion 53 of the electric component box 50. In the temporarily fixing step before the electric component box 50 is fixed, a worker is required to position the upper end of the heat exchanger 40 relative to the gap between the second plate portion 101B and the rear surface portion 53 and then insert the upper end of the heat exchanger 40 into the gap. More specifically, the worker roughly positions the electric component box 50 such that the electric component box 50 is located above the heat exchanger 40, and moves the electric component box 50 downward toward the heat exchanger 40. Next, the worker finely adjusts the position of the electric component box 50 in the front-back direction, with the second plate portion 101B kept in contact with the upper end of the heat exchanger 40. Thus, the worker can insert the upper end of the heat exchanger 40 into the gap between the second plate portion 101B and the rear surface portion 53. That is, the worker does not need to view the rear surface of the electric component box 50, and can easily temporarily fix the electric component box 50 only with his or her feeling at hand.

According to Embodiment 1, during work in which the electric component box 50 is fixed by the first positioning member 101 and the second positioning member 102 by, for example, screws, displacement of the electric component box 50 from the position where the electric component box 50 is temporarily fixed is reduced. It is therefore stably fix the electric component box 50, thereby improving the workability at the time of setting the electric component box 50 at the outdoor unit 1.

According to Embodiment 1, the electric component box 50 is set on the separator 60 while temporarily fixed by the first positioning member 101 and the second positioning member 102. Therefore, it is possible to stably support the electric component box 50 during the work.

According to Embodiment 1, the electric component box 50 is held in the vertical direction by the first plate portion 101A of the first positioning member 101 and the separator 60. It is therefore possible to prevent the electric component box 50 from falling during the work.

According to Embodiment 1, at the bottom surface portion 54 of the electric component box 50, the second positioning member 102 is provided closer to the front surface portion 52 than to the rear surface portion 53. Therefore, the worker can bring the second positioning member 102 into contact with the separator 60 while viewing the second positioning member 102 from the front side of the outdoor unit 1, thus easily doing the work.

The first positioning member 101 is subjected to the adhesion bending process. Therefore, even if the first positioning member 101 comes into contact with another component or portion when the electric component box 50 is temporarily fixed and when the first positioning member 101 is detached, the possibility that the above other component or portion will be cut by the first positioning member 101 is reduced.

Regarding Embodiment 1, the work of temporarily fixing the electric component box 50 is described above; however, it is an example of the work to be done in Embodiment 1. That is, the work to be done in Embodiment 1 is not limited to the work of temporarily fixing the electric component box 50. Also, in work of repairing the outdoor unit 1 or maintenance work for the outdoor unit 1, that is, maintenance or repair service after installation of the outdoor unit 1, the same advantages as described above are obtained.

Embodiment 2

Figure 12:
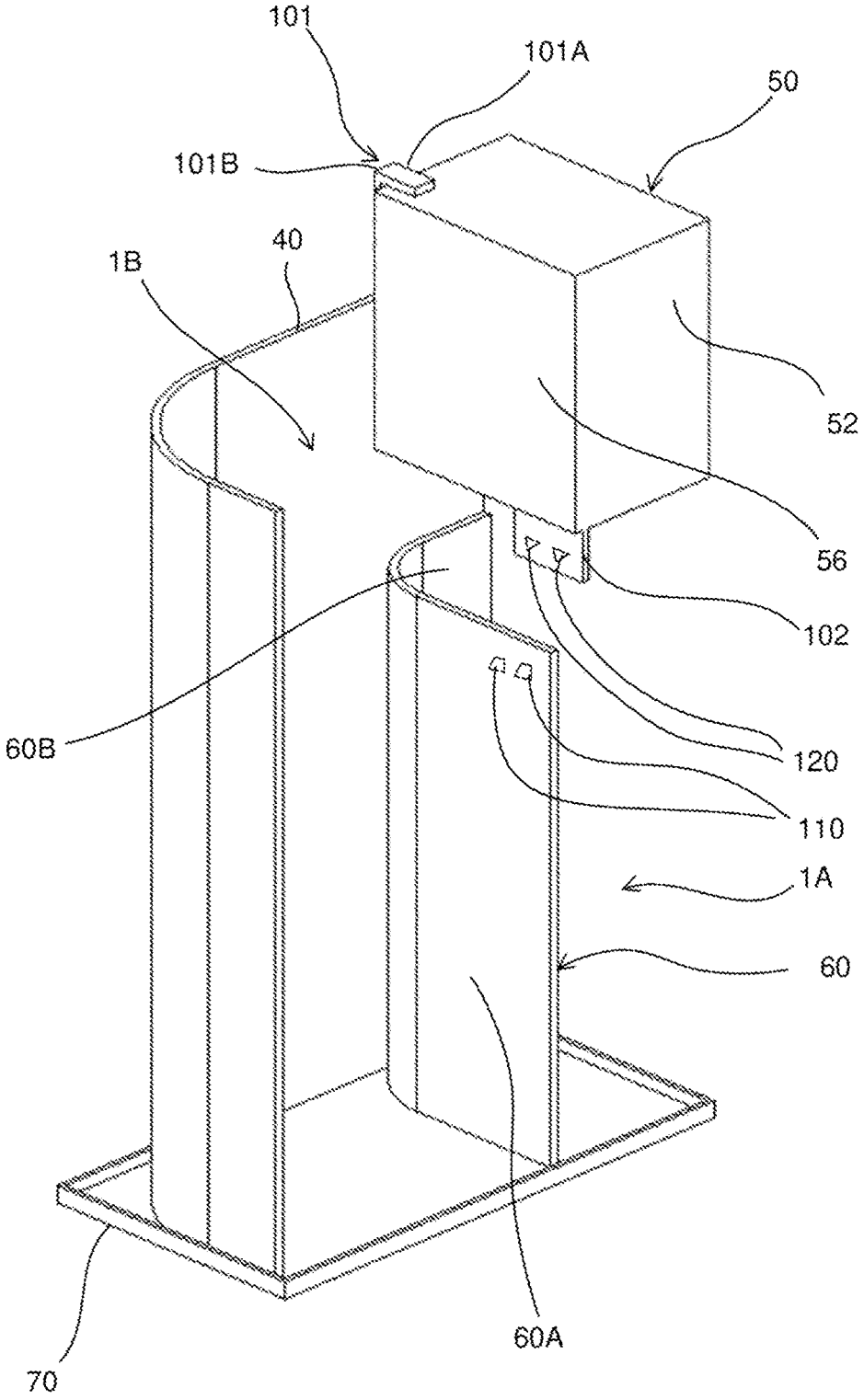
FIG. 12 is an exploded perspective view conceptually illustrating a relative positional relationship between components in an outdoor unit according to Embodiment 2.

FIG. 12 is an exploded perspective view conceptually illustrating a relative positional relationship between components provided in an outdoor unit according to Embodiment 2. In FIG. 12, components that are same as components in Embodiment 1 as described with reference to FIGS. 1 to 11 are denoted by the same reference signs. Furthermore, in the following description, components denoted by the same reference signs as the components in Embodiment 1 are also the same as the components of Embodiment 1 as described with reference to FIGS. 1 to 11. Detailed descriptions of the components that are same as the components of Embodiment 1 will be omitted.

In Embodiment 2, two claws 110 are provided at the first surface 60A of the separator 60. Each of the claws 110 is formed by cutting part of the first surface 60A and raising the cut part toward the machine chamber 1A. The two claws 110 are provided side by side in the front-back direction at the first surface 60A. In addition, two openings 120 are provided in the second positioning member 102 of the electric component box 50. The two openings 120 are located side by side in the front-rear direction at the second positioning member 102. The distance between the two claws 110 in the front-back direction is nearly equal to that between the two openings 120 in the front-rear direction.

Figure 13:
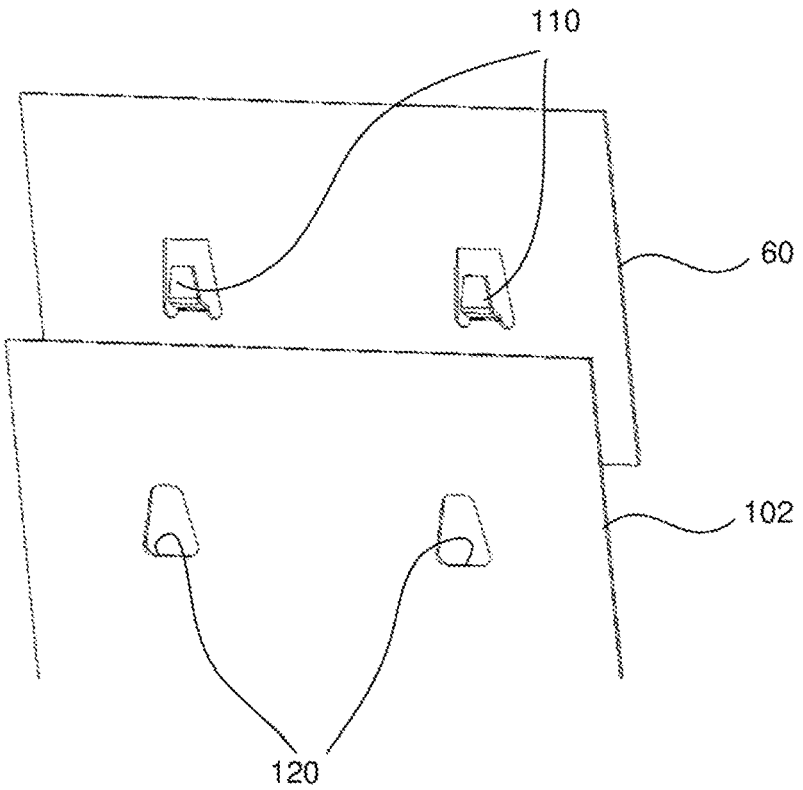
FIG. 13 illustrates engagement members and to-be-engaged members according to Embodiment 2 in the case where the engagement members and the to-be-engaged members are still not engaged with each other.
Figure 14:
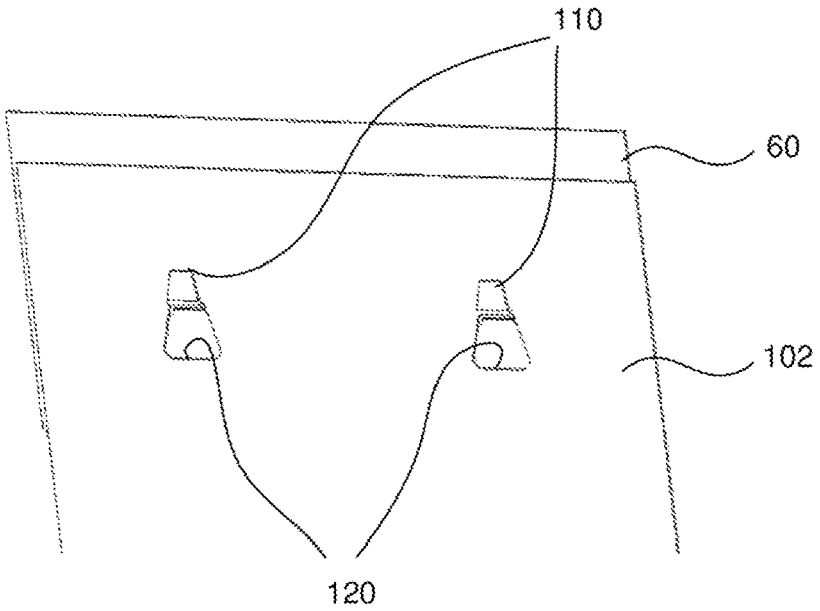
FIG. 14 illustrates the engagement members and the to-be-engaged members according to Embodiment 2 in the case where the engagement members and the to-be-engaged members are engaged with each other.

FIG. 13 illustrates engagement members and to-be-engaged members according to Embodiment 2 in the case where the engagement members and the to-be-engaged members are still not engaged with each other. FIG. 14 illustrates the engagement members and the to-be-engaged members according to Embodiment 2 in the case where the engagement members and the to-be-engaged members are engaged with each other. The second positioning member 102 is brought close to the first surface 60A of the separator 60, the claws 110 are inserted into the respective openings 120, and the electric component box 50 is then shifted downward. As a result, the claws 110 are hooked to upper portions of the respective openings 120, and the second positioning member 102 is engaged with the separator 60.

According to Embodiment 2, displacement of the electric component box 50 in the vertical direction and in the front-rear direction is reduced by engagement of the claws 110 with the openings 120. Thus, the electric component box 50 is temporarily fixed with a higher reliability.

The invention claimed is:

1. An outdoor unit of an air-conditioning apparatus, comprising:

a housing;

a heat exchanger provided in the housing;

an electric component box provided in the housing; and a separator that partitions an inside of the housing into a first chamber and a second chamber, wherein the separator is provided at a front surface of the heat exchanger, the first chamber and the second chamber are provided side by side in a lateral direction as viewed in a head-on view of the outdoor unit, the electric component box is provided at the front surface of the heat exchanger, in the first chamber, and above the separator, the outdoor unit further comprising:

a first positioning member provided on the electric component box, and configured to determine a position of the electric component box in a vertical direction and in a front-rear direction relative to the heat exchanger; and a second positioning member provided on a bottom surface of the electric component box, and configured to determine a position of the electric component box in the lateral direction relative to the separator, the second positioning member being provided apart from a left side portion of the electric component box in a direction toward the first chamber by a predetermined distance, and being in contact with a surface of the separator that faces the first chamber, the left side portion being located on a left side as viewed in a head-on view of the outdoor unit.

2. The outdoor unit of the air-conditioning apparatus of claim 1, wherein the electric component box is set on an upper end of the separator.

3. The outdoor unit of the air-conditioning apparatus of claim 1, wherein the first positioning member includes a first plate portion and a second plate portion, the first plate portion being in contact with a top surface of the electric component box and extending along the front-rear direction, the second plate portion intersecting the first plate portion and extending downward, and an upper end of the heat exchanger is held by the electric component box and the second plate portion.

4. The outdoor unit of the air-conditioning apparatus of claim 1, wherein the second positioning member is a plate portion that protrudes downward from the bottom surface of the electric component box, and is in contact with the separator.

5. The outdoor unit of the air-conditioning apparatus of claim 4, wherein at the bottom surface of the electric component box, the second positioning member is provided closer to a front surface of the electric component box than to a rear surface of the electric component box.

6. The outdoor unit of the air-conditioning apparatus of claim 5, wherein one of the second positioning member and the separator is engaged with the other.

7. The outdoor unit of the air-conditioning apparatus of claim 6, wherein the second positioning member includes an opening formed therein, the separator includes a claw provided thereat, and the claw is engaged with the opening.

8. The outdoor unit of the air-conditioning apparatus of claim 1, wherein the predetermined distance is greater than a thickness of the separator.

* * * * *